US009057171B2

(12) United States Patent
Ferraiolo

(10) Patent No.: US 9,057,171 B2
(45) Date of Patent: Jun. 16, 2015

(54) BLOCK FOR RETAINING WALL

(75) Inventor: Francesco Ferraiolo, Ca' de' Fabbri (IT)

(73) Assignee: OFFICINE MACCAFERRI S.P.A., Zola Predosa (BO) (IT)

( * ) Notice: Subject to any disclaimer, the term of this patent is extended or adjusted under 35 U.S.C. 154(b) by 0 days.

(21) Appl. No.: 13/634,278

(22) PCT Filed: Apr. 8, 2011

(86) PCT No.: PCT/IB2011/051529

§ 371 (c)(1),
(2), (4) Date: Sep. 12, 2012

(87) PCT Pub. No.: WO2011/125052

PCT Pub. Date: Oct. 13, 2011

(65) Prior Publication Data

US 2013/0034392 A1 Feb. 7, 2013

(30) Foreign Application Priority Data

Apr. 8, 2010 (IT) ..... BO2010A0213

(51) Int. Cl.
*E02D 29/02* (2006.01)

(52) U.S. Cl.
CPC ..... *E02D 29/0241* (2013.01); *E02D 29/025* (2013.01)

(58) Field of Classification Search
USPC ..... 405/262, 284–287; 52/604, 606, 608
See application file for complete search history.

(56) References Cited

U.S. PATENT DOCUMENTS

| | | | | |
|---|---|---|---|---|
| 5,257,880 | A | 11/1993 | Janopaul, Jr. | |
| 5,540,525 | A | 7/1996 | Miller et al. | |
| 5,595,460 | A | 1/1997 | Miller et al. | |
| 5,601,384 | A * | 2/1997 | Dawson | 405/284 |

(Continued)

FOREIGN PATENT DOCUMENTS

| | | | |
|---|---|---|---|
| BR | PI0800868-0 | A | 8/2008 |
| JP | 2974783 | B2 | 2/1998 |
| JP | 11-021921 | A | 1/1999 |
| WO | WO 2006/043739 | A1 | 4/2006 |

OTHER PUBLICATIONS

Form PCT/ISA/220 mailed Aug. 9, 2011 (1 page).

(Continued)

*Primary Examiner* — Sunil Singh
(74) *Attorney, Agent, or Firm* — Flynn, Thiel, Boutell & Tanis, P.C.

(57) ABSTRACT

A block for a retaining wall having a front face forming part of a visible side of a retaining wall, and a support face which supports at least one similar overlying block. The support face is angled with respect to the front face and traversed by a through opening which defines an internal abutment surface placed at a first predetermined distance from the front face. A reference element protrudes from the support face at a second predetermined distance from the front face, in order to abut, in use, against the at least one internal abutment surface of the similar overlying block and thus prevent the displacement thereof in only one of two directions which are transverse to the front face. The reference element includes a flattened engagement portion. An elongate slot is provided on the support face to receive the corresponding flattened engagement portion.

13 Claims, 3 Drawing Sheets

(56) References Cited

U.S. PATENT DOCUMENTS

Figure 2:
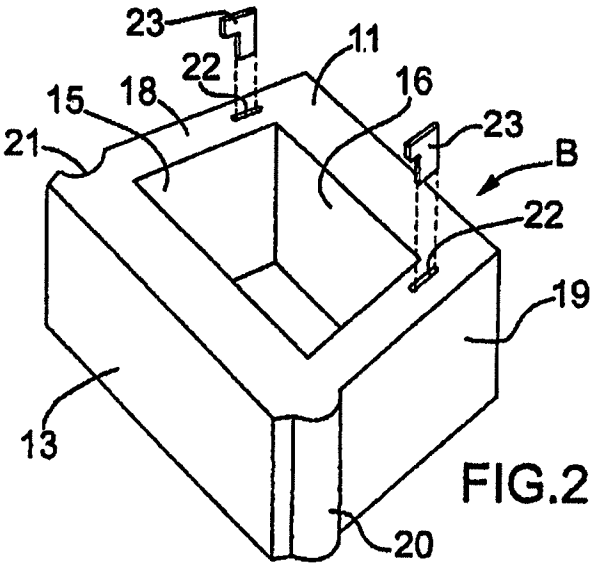

| | | | | |
|---|---|---|---|---|
| 6,115,983 | A * | 9/2000 | Poignard | 52/606 |
| 2002/0001509 | A1 * | 1/2002 | Hong | 405/286 |
| 2005/0069389 | A1 | 3/2005 | Shaw | |
| 2008/0289283 | A1 | 11/2008 | Shin | |

OTHER PUBLICATIONS

Form PCT/ISA/210 mailed Aug. 9, 2011 (3 pages).
Form PCT/ISA/237 mailed Aug. 9, 2011 (5 pages).
Office Action of Japan Patent Office issued in Application No. 2013-503213 with English translation dated Aug. 26, 2014 (5 pages).

* cited by examiner

BLOCK FOR RETAINING WALL

The present invention relates to a block for producing retaining structures, for example for embankments and the like. The invention further relates to a method for the production of a retaining wall and to a retaining wall thus obtained.

The invention has been developed with particular, although not limited, regard to a block for a wall or other retaining structure, for example embankments and the like structures, of the type comprising a front face intended to form part of a visible side of a retaining wall, and a support face intended to support and bear, in the production of the visible side, at least one similar overlying block. The blocks are placed alongside one another in superimposed horizontal rows in order to produce, as a whole, the retaining wall. In order to produce walls with homogeneous visible sides, for example vertical or with constant inclination, or with large steps, the various blocks of the same horizontal row are aligned at a certain distance with respect to the blocks of the underlying row by means of mutual reference elements.

Blocks of this type are known, such as for example the block described in Brazilian Patent No. PI 0800868-0 A, in which two posts protrude from the upper face of the block in such a way as to be inserted, during the step of producing the wall, into corresponding niches provided on the lower face of one or two overlying blocks, in order to permit the alignment of the rows of blocks and to produce a wall with a visible side of predetermined configuration, for example vertical or with steps. One problem with the blocks of known type is that the positioning of the blocks is difficult because the centring of the posts of the underlying blocks in the niches of the overlying blocks requires considerable accuracy of alignment in the step of placing one block on the other. Since the blocks are generally of considerable weight, the operation is very fatiguing if carried out manually, or in any case complex even if carried out with the help, for example, of a crane or other lifting means. The incorrect positioning of one block on the other may result in the unwelcome drawback of breakage of the posts of the underlying block, thus compromising the functioning thereof. The laying of the blocks of known type becomes even more complex, and more subject to errors, in the case where multiple niches are provided for producing walls with a variously configured visible side, for example vertical or with steps. In such a case, it is necessary also to select the correct niches into which the posts are to be inserted, with a consequent increase in complexity and time in the block laying operations.

The document US 2008/0289283 describes a block for walls with a particular system of attachment by ground reinforcement strips. The strips hook on to two posts which protrude from the upper face of each block and act as a stop for aligning the superimposed blocks. In particular, each post has ends of different thickness, in such a way that, when one or the other end of each post is inserted into the block, they make it possible to produce walls that are vertical or slightly inclined, by coming into abutment on the rear side of the front through opening of a superimposed block. The wall block which is described in the document US 2008/0289283 is not very practical and is difficult to use in the real conditions of building sites. The operatives trained to insert the aforesaid posts in the blocks must pay particular attention to the direction of insertion of the posts, which have ends that are very similar to one another and are difficult to distinguish from one another in the often dusty, muddy or in any case generally dirty conditions resulting from the excavations on the building sites. An error of insertion of the aforesaid posts results in errors of alignment of the blocks, which seriously compromise the production of the containing walls unless the work of reinsertion of the posts and realignment of the blocks is carried out again, with the serious expenditure of time and money which follows therefrom.

Another disadvantage of the technique illustrated in the document US 2008/0289283 is the scant flexibility of use in the production of inclined retaining walls, since the thickness of the steps that can be produced is limited by the small difference in thickness of the two ends of the posts used.

A further disadvantage of the posts referred to in the document US 2008/0289283 is that they are fragile, and can easily be broken into pieces if an upper block is placed onto them too quickly, given the considerable weight that these blocks may reach and the consequent poor maneuverability thereof.

The aim of the present invention is that of solving the problems of the prior art and in particular of providing a block which is easy to lay and which at the same time ensures flexibility such as to permit the production of vertical walls, inclined walls and walls with steps, also of varied width, without requiring special attention or particularly skilled operatives. A further aim of the invention is that of producing a block which is economic, simple, durable, strong and relatively manageable.

In order to achieve the aims indicated above, the object of the present invention is a block for a retaining wall comprising a front face intended to form part of a visible side of a retaining wall, and a support face intended to support and bear, in the production of the visible side, at least one similar overlying block. The support face is angled with respect to the front face and is traversed by at least one through opening defining at least one internal abutment surface located at a first predetermined distance from the front face. Reference means protrude from the support face at least at a second predetermined distance from the front face, in order to come into abutment, in use, against the at least one internal abutment surface of the similar overlying block and thus prevent its displacement in only one of the two directions which are transverse to the front face. The reference means comprise at least one flattened engagement portion, at least one slot elongate in a direction transverse to the front face being provided on the support face to receive the corresponding flattened engagement portion of the reference means.

The invention also has as its object a method for the production of a retaining wall, as well as a retaining wall.

It is an advantage of the present invention that it is possible for the operator, during the laying of the block, to look from above, through the at least one through opening, at the row of underlying blocks and move the block in order to see the reference means of one or two underlying blocks. The block to be laid can then be lowered and kept slightly raised, by hand if of small dimensions, or for example with a crane if of larger dimensions and greater weight, at a slight distance from the row of underlying blocks. In this position, the block may be moved slightly, until the reference means touch the internal abutment side. At that point, the block can easily be placed on the row of underlying blocks.

The reference means are easy and convenient to position, since they comprise a flattened portion, the direction of insertion of which is easy to identify on the corresponding elongate slot provided on the block, even in the dirty and dusty conditions of a building site.

According to a preferred form of embodiment, the through opening in the block, through which it is possible to see the reference means of the blocks of the underlying row and which serves as an abutment therefor, is relatively wide, such that it is easy to insert the reference means therein without running the risk of damaging them. The wide through opening has the additional advantage of lightening the block considerably in a central zone which is of little use for its overall strength.

Advantageously, the reference means protrude from the block with a portion widened in a direction transverse to the front face, that is, in the direction in which the block is generally displaced until the reference means touch the internal abutment side. In this way, the reference means are particularly strong precisely in the direction of displacement of the block during the laying operations, with the advantage therefore of being much less subject to accidental breakage or fracture during the operations of reference of a block on the row of underlying blocks.

According to a preferred form of embodiment, the reference means are selectively movable or removable so as to assume at least two different configurations, each at a different distance from the front face, in order thus to make it possible to vary the relative position of superimposed blocks and therefore the configuration of the visible side of the retaining wall.

The reference means are preferably L-shaped, with a flattened leg which can be inserted into the corresponding slit or slot on the block, and a wider head which, depending on the direction of insertion of the flattened leg into the slot on the block, can protrude towards the front face or the rear face of the block. This particular shape of the reference means of the present invention makes it possible to produce various configurations of a wall simply by selecting the direction of insertion of the reference means, and their state of bearing on one of the internal sides of the overlying block/s. Since they can be inserted rotated into different positions, preferably in two opposed positions rotated through 180° with respect to each other (even though the possibility is not excluded of different rotation positions being provided, for example by providing multiple slots, variously orientated, on the blocks), the reference means of the present invention facilitate or allow different types of abutment or bearing of the overlying block or blocks, in such a way as to obtain a wall which is vertical, inclined or with wide steps, and which follows a straight or also a curved path in plan view.

Figure 4:
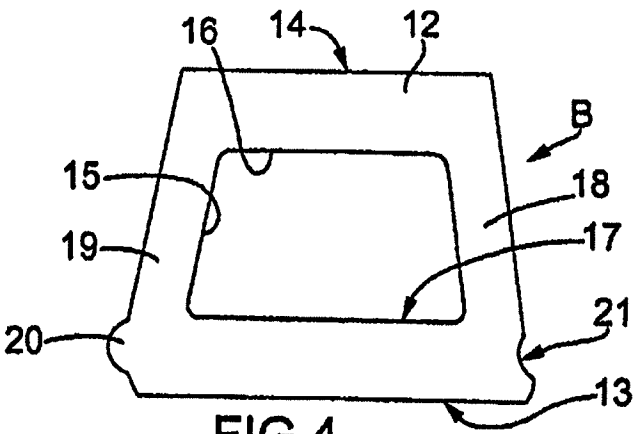
Figure 1:
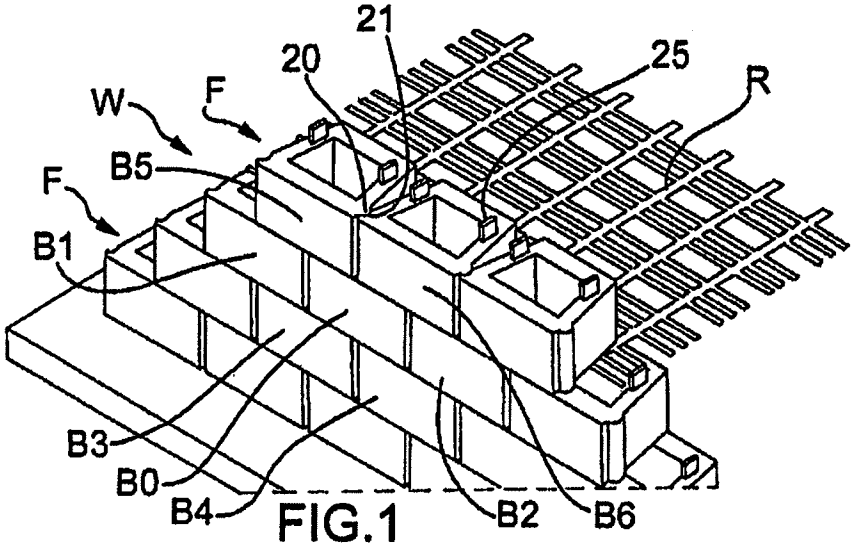
Figure 3:
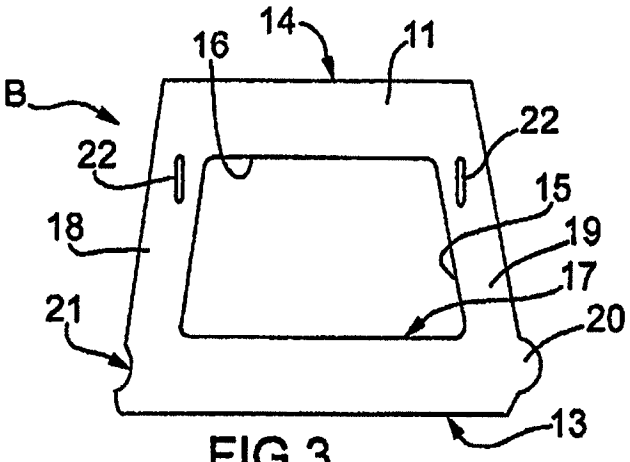
Figure 6:
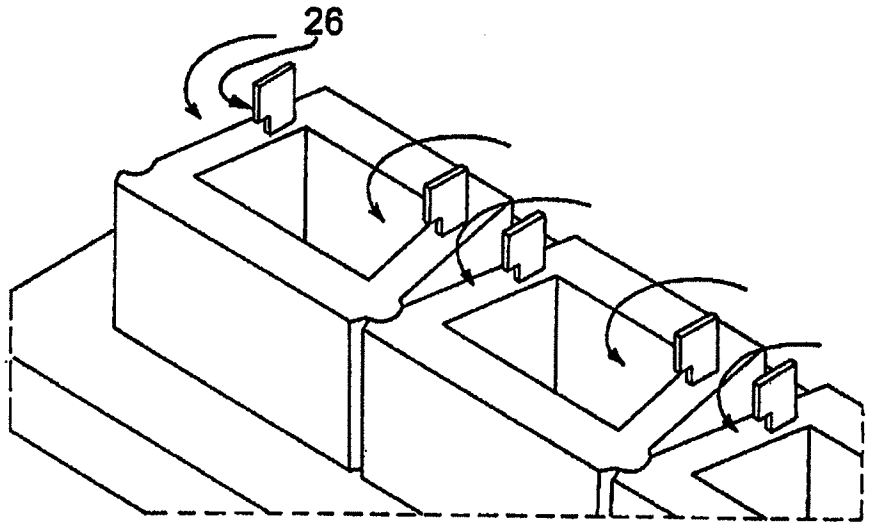
Figure 8:
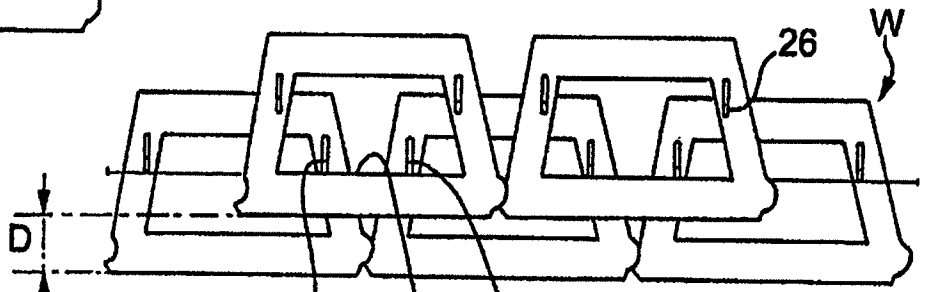
Figure 5:
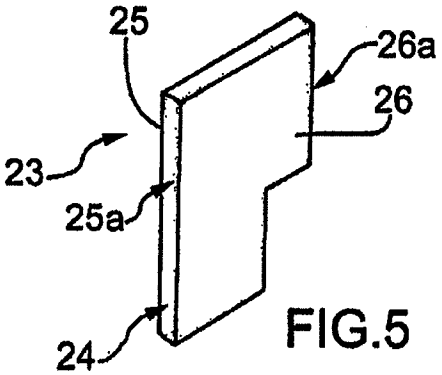
Figure 7:
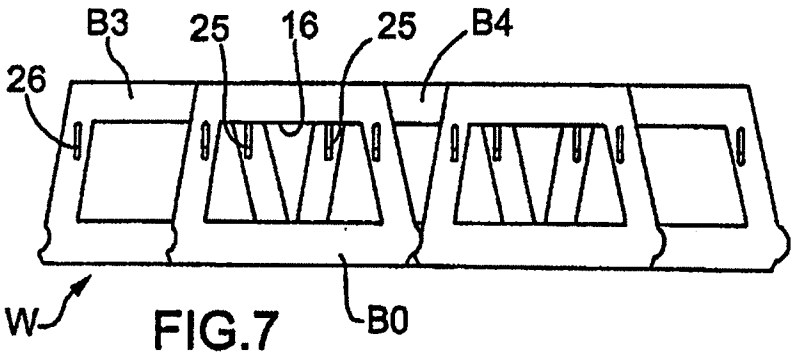
Figure 10:
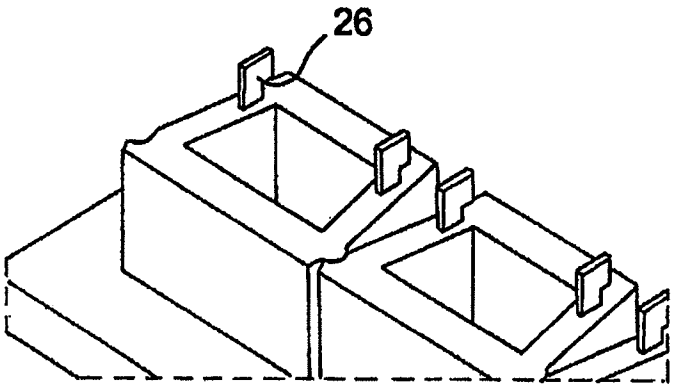
Figure 9:
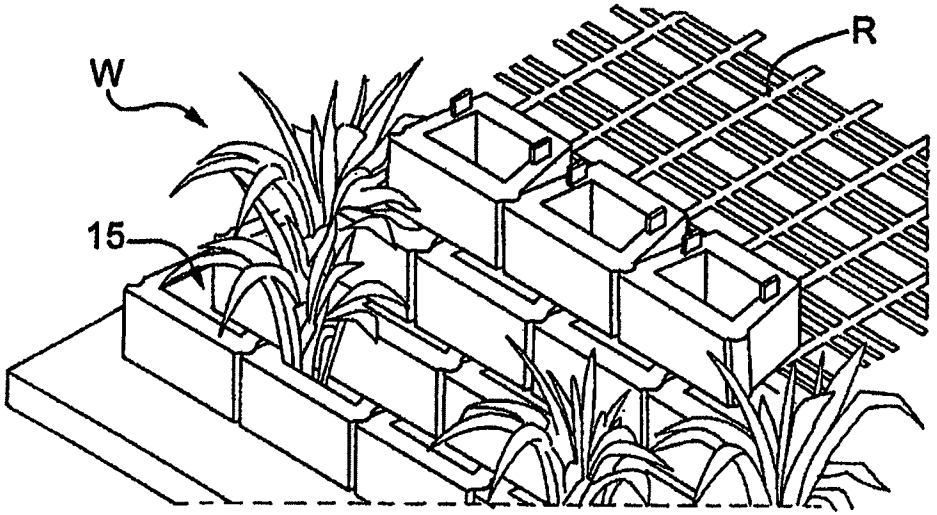
Figure 11:
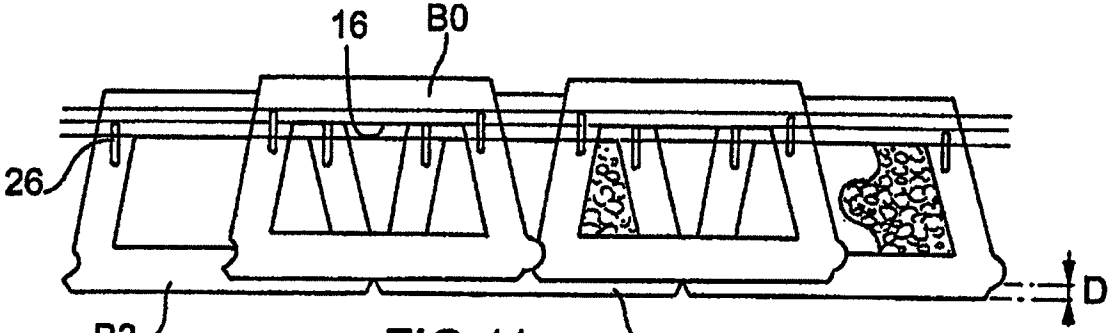

Further features and advantages will become clear from the following detailed description of a preferred form of embodiment of the invention, with reference to the appended drawings, provided purely by way of non-limiting example and in which:

FIG. 1 is a perspective view of a portion of wall produced with superimposed rows of blocks according to the present invention, wherein, for the sake of simplicity, the embankment retained by the wall is not illustrated, FIG. 2 is a diagrammatic view in perspective of a block according to the invention, FIG. 3 is a plan view of the block of FIG. 2, FIG. 4 is a view from below of the block of FIG. 2, FIG. 5 is a perspective view, on an enlarged scale, of a particular reference element, FIG. 6 is a perspective view of a row of blocks with a first configuration of the reference elements, FIG. 7 is a schematic plan view of a portion of wall produced according to a first variant, FIG. 8 is a schematic plan view, similar to the view of FIG. 7, of a wall produced according to a second variant, FIG. 9 is a perspective view of a portion of wall produced according to the second variant of FIG. 8 and replanted, FIG. 10 is a perspective view, similar to FIG. 6, of a row of blocks with a second configuration of the reference elements, and FIG. 11 is a schematic plan view, similar to the views of FIGS. 7 and 8, of a wall produced according to a third variant.

With reference now to FIG. 1, a retaining wall W, for example for embankments, slopes and the like, is obtained by placing a series of blocks B side by side in such a way as to form rows F superimposed one upon the other. The blocks B are generally made of concrete or other common building materials. In more detail, the rows F are superimposed in such a way that each block B of one row is laterally offset with respect to the blocks of the underlying and overlying rows, preferably by a measurement equal to half a block. As indicated for example in FIG. 1, the block B0 has two lateral blocks B1 and B2 alongside it and is superimposed on two underlying blocks B3 and B4, while two overlying blocks B5 and B6 rest on the block B0.

The retaining wall W may be provided, on the side to the rear of its visible face, with reinforcing meshes R suitable for producing a reinforced piece of ground. The reinforcing meshes R may be laid out horizontally and anchored to the retaining wall W with one of their ends locked between two rows F of superimposed blocks.

As can be seen in FIGS. 2 to 4, each block B comprises an upper support face 11 and a lower bearing face 12 which are parallel to each other, a front face 13, which is visible when the block is part of a retaining wall, and a rear face 14. Between the upper face 11 and the lower face 12 a through opening 15 is provided, preferably wide with respect to the area of the upper face 11 and lower face 12, and which defines within it a rear internal surface 16 and a front internal surface 17. Overall, the block B is therefore formed of four peripheral sides which, in plan view, as can be seen in FIGS. 3 and 4, assume a trapezoidal configuration with the major base corresponding to the front face 13. Provided on the sides 18 and 19 of the block B are means for horizontal alignment 20 and 21 of known type, comprising a protuberance 20, in the form of a convex vertical rib, provided on a lateral side, for example on the right-hand side 19, and a complimentary recess 21, in the form of a concave vertical groove, provided on the left-hand lateral side 18. The protuberance 20 and the recess 21 both extend from the upper face 11 to the lower face 12, and are substantially in the shape of a half-cylinder with the same radius.

Provided on the upper face 11 of the block B, in a position which is set back from the front face 13, and spaced apart in the transverse direction, are two elongate slots 22, preferably of substantially rectangular cross-section, which are intended to receive two reference elements 23 constituted by a plate having an upside down L-shape, which can be seen more easily in FIG. 5. Each reference element 23 comprises a flattened leg 24 to be inserted into the elongate slot 22 and an outer reference portion 25 which comprises a tooth 26, coplanar with but laterally protruding with respect to the leg 24. The edges 25*a* and 26*a* of the reference portion 25 and of its tooth 26 act as reference members, one or the other of which comes into abutment against an internal surface of the inner cavity 15 of one of the two overlying blocks, as specified in more detail below in the present description.

In the production of a retaining wall W, the horizontal rows F of blocks are produced by placing one block B laterally beside another, using the reference provided by the rib or protuberance 20 of one block which is received in a corresponding groove 21 of the adjoining block. The particular trapezoidal configuration of the blocks, seen in plan view, makes it possible not only to place the various blocks side by side with the front faces 13 aligned in the same plane, but also to rotate the blocks relatively by a certain angle in order to produce a curved retaining wall. The presence of the ribs or protuberances 20 and of the respective grooves 21, as well as any other reference means for one block with respect to an adjoining block, is a preferred, but not limitative, feature of the present invention.

Beyond its configuration in plan view, the vertical extension of the retaining wall that can be produced with the blocks of the present invention may assume various forms, depending on the configurations of the reference elements 23.

In a first configuration, the legs 24 of the reference elements 23 are each inserted into a corresponding elongate slot 22 of a block B, in such a way that the teeth 26 of the respective reference portions 25 which protrude from the upper support surface 11 are both facing towards the front face 13 of the block, as is clearly shown in FIG. 6. In this first configuration, the edge 25*a* of the reference portion 25 faces towards the back of the block and is aligned with the rear internal side 16 of the inner cavity 15. The edge 26*a* of the tooth 26 is however displaced towards the front face 13 by a measurement corresponding to the width of the reference portion 25. In this first configuration, it is possible to produce two different variants of the vertical extension of the visible face of the retaining wall W.

A first variant is illustrated schematically in FIG. 7. In this case, the rear internal side 16 of a block B0 is placed in abutment against the edges 25*a* of two reference elements 23 of the two underlying blocks B3, B4, so as to permit the vertical alignment of the blocks, in particular producing a vertical visible front side.

A second variant is illustrated schematically in FIG. 8. Still in the first configuration of the reference elements 23, it is possible to produce a visible front side with wide steps. The predetermined distance D between the steps is obtainable simply by bringing the front internal side 17 of an overlying block in abutment against the front edge 26*a* of the tooth 26. In this second variant with wide steps of the visible face of the wall W, a portion of the through opening 15 is accessible even when the wall W is assembled, thus making it possible to produce a replanted wall by filling the cavities with earth and, optionally, plants, bushes and the like (FIG. 9).

In a second configuration, the legs 24 of the reference elements 23 are each inserted into a corresponding elongate slot 22 of a block B, in such a way that the teeth 26 of the respective reference portions 25 which protrude from the upper support face 11 both face towards the rear face 14 of the block, as is clearly shown in FIG. 10. In this second configuration, the edge 26*a* of the tooth 26 faces towards the back of the block and is set back with respect to the rear internal side 16 of the inner cavity 15. The edge 25*a* of the reference portion 25 however faces towards the front face 13. In this second configuration, it is possible to produce a third variant of the vertical extension of the visible face of the wall W, in which the rear internal side 16 of a block B0 is brought into abutment against the edges 26*a* of two underlying blocks B3, B4, so as to produce a visible front side with small steps, in which the superimposed blocks have their front faces offset by a distance D' (FIG. 11) corresponding to the width of the teeth 26 of the reference elements 23.

Provision may be made for the manufacture or the on site supply of different sets of reference elements 23, each having teeth 26 of a different width, so as to provide further variants in the production of visible faces with steps of different depths. In a simplified form of embodiment, reference elements 23 devoid of the tooth 26 are manufactured or supplied on site; in this way, while ensuring the possibility of producing two variants of the visible face of a retaining wall W, vertical or with wide steps, the risk is reduced of mounting in the wrong direction the reference elements of the slots 22 on the blocks.

According to one possible variant, the reference elements 23 are made in one piece with the block, also in this case simplifying the assembly of the blocks while ensuring the possibility of producing two variants of the visible face of the retaining wall W, one with the protuberances 25 in abutment with the front internal abutment side 17 for a visible face with wide steps, and the other with the protuberances 25 in abutment with the rear internal abutment side 16 for a vertical visible face.

Although in the preferred form of embodiment the reference elements 23 protrude from the upper face of the blocks, it is however possible—when construction requirements make it advisable and more suitable—to produce blocks with reference elements 23 protruding from the lower face.

Moreover, it is possible to produce dividing partitions, intermediate walls or similar structural elements which subdivide the wide opening into two or more smaller openings, as long as portions of the rear, 16, and front, 17 abutment internal walls remain available for the reference function via abutment with the reference means 23 of one or more underlying blocks.

The blocks of each course may be aligned in a straight sequence, or also to form walls of curved plan. Also, varied elongate slots 22 may be provided on each block, oriented at angles different from the transverse alignment to the front face, in order to obtain possible different configurations of steps of the wall.

Naturally, the principle of the invention remaining the same, the forms of embodiment and details of construction may be varied widely with respect to those described and illustrated, without thereby departing from the scope of the invention.

The invention claimed is:

1. A block for a retaining wall, comprising a front face intended to form part of a visible side of a retaining wall and a support face intended to support and bear, in the production of the visible side, at least one similar overlying block, the support face being angled with respect to the front face and traversed by at least one through opening defining at least one internal abutment surface placed at a first predetermined distance from the front face, at least one flattened engagement plate protruding from the support face at least at a second predetermined distance from the front face in order to come into abutment, in use, against the at least one internal abutment surface of the similar overlying block and thus prevent displacement thereof in only one of two directions which are transverse to the front face, and at least one slot elongate in a direction transverse to the front face being provided on the support face to receive the at least one flattened engagement plate in order to produce a retaining wall having a configuration of the visible side selected from at least two possible configurations of that side, the at least one flattened engagement plate is upside down L-shaped and comprises a flattened leg and an outer reference portion coplanar with, but laterally protruding from, the flattened leg, the flattened engagement plate having opposite faces that are planar on opposite faces of the flattened engagement plate, each of the opposite faces including a portion of the flattened leg and the outer reference portion; the at least one slot being narrow and the flattened leg having a cross-sectional shape substantially corresponding to a cross-sectional shape of the at least one slot such that a cross-section of the flattened leg includes external surfaces that are slightly smaller than a continuous closed internal surface of the slot with substantially no space between the flattened leg and the internal surface of the slot when the flattened engagement plate is inserted into the slot.

2. The block for a retaining wall according to claim 1, wherein the block comprises a single through opening which involves a major part of a surface of the support face.

3. The block for a retaining wall according to claim 1, wherein the through opening defines two internal abutment surfaces placed at two respective predetermined distances from the front face for the production of walls having different configurations of the visible side by bringing the at least one flattened engagement plate into abutment with one of the two internal abutment surfaces.

4. The block for a retaining wall according to claim 1, wherein the at least one flattened engagement plate is selectively movable in order to assume at least two different abutment configurations in which the at least one flattened engagement plate protrudes from the support face at least at two predetermined distances from the front face for varying a relative position of superimposed blocks and therefore a configuration of the visible side of the retaining wall.

5. The block for a retaining wall according to claim 4, wherein the at least one flattened engagement plate is removable.

6. The block for a retaining wall according to claim 1, wherein the at least one flattened engagement plate comprises a pair of plates which protrude from the support face and are spaced apart from each other in a direction parallel to the front face.

7. A method for the production of a retaining wall, including the following steps:

providing a plurality of retaining wall blocks, each wall block comprising a front face intended to form part of a visible side of a retaining wall and a support face intended to support and bear, in the production of the visible side, at least one similar overlying block, the support face being angled with respect to the front face and traversed by at least one through opening defining at least one internal abutment surface placed at a first predetermined distance from the front face, at least one flattened engagement plate protruding from the support face at least at a second predetermined distance from the front face in order to come into abutment, in use, against the at least one internal abutment surface of the similar overlying block and thus prevent displacement thereof in only one of two directions which are transverse to the front face, and at least one slot elongate in a direction transverse to the front face being provided on the support face to receive the at least one flattened engagement plate in order to produce a retaining wall having a configuration of the visible side selected from at least two possible configurations of that side, wherein the through opening of each block defines two internal abutment surfaces placed at two respective predetermined distances from the front face, the at least one flattened engagement plate is upside down L-shaped and comprises a flattened leg and an outer reference portion coplanar with, but laterally protruding from, the flattened leg;

producing a first horizontal row of blocks alongside one another with the front faces substantially contiguous;

selecting one of the two aforesaid internal abutment surfaces of all the blocks which are to be brought in abutment with the at least one flattened engagement plate of underlying blocks in order to produce a retaining wall having a configuration of the visible side selected from at least two possible configurations of the visible side; and producing a second horizontal row of overlying blocks bearing on the blocks of the first horizontal row in such a way that the at least one flattened engagement plate protruding from the support faces of the blocks of the first horizontal row come into abutment against the aforesaid selected internal abutment surfaces of the overlying blocks of the second row thus defining a predetermined distance between the front faces of the blocks of the second horizontal row and the front faces of the blocks of the first row and preventing the displacement thereof in only one of the two directions which are transverse to the front faces;

wherein the flattened engagement plate has opposite faces that are planar on opposite faces of the flattened engagement plate, each of the opposite faces including a portion of the flattened leg and the outer reference portion; and wherein the at least one slot is narrow and the flattened leg has a cross-sectional shape substantially corresponding to a cross-sectional shape of the at least one slot such that a cross-section of the flattened leg includes external surfaces that are slightly smaller than a continuous closed internal surface of the slot with substantially no space between the flattened leg and the internal surface of the slot when the flattened engagement plate is inserted into the slot.

8. The method for the production of a retaining wall according to claim 7, wherein the blocks of the second horizontal row are offset with respect to the blocks of the first horizontal row such that each through cavity receives at least two of the at least one flattened engagement plate of two different underlying blocks.

9. The method for the production of a retaining wall according to claim 7, wherein the at least one flattened engagement plate of each block is selectively movable in order to assume at least two different abutment configurations on at least one internal abutment surface, the method comprising the step of selecting one of the at least two abutment configurations of the at least one flattened engagement plate of all the blocks on which to bring into abutment the same at least one internal abutment surface of the overlying blocks in order to produce a retaining wall having a configuration of the visible side selected from at least two possible configurations of the visible side.

10. The method for the production of a retaining wall according to claim 7 wherein ground reinforcing meshes are anchored between two rows of blocks and extend inside the ground on the opposite side from the visible side.

11. A retaining wall comprising a plurality of rows of blocks according to claim 1 placed alongside one another in superimposed horizontal rows.

12. The retaining wall according to claim 11, produced by a method including the following steps:

providing the plurality of retaining wall blocks, wherein the through opening of each block defines two internal abutment surfaces placed at two respective predetermined distances from the front face;

producing a first horizontal row of blocks alongside one another with the front faces substantially contiguous;

selecting one of the two aforesaid internal abutment surfaces of all the blocks onto which are to be brought in abutment the at least one flattened engagement plate of underlying blocks in order to produce a retaining wall having a configuration of the visible side selected from at least two possible configurations of the visible side; and producing a second horizontal row of overlying blocks bearing on the blocks of the first horizontal row in such a way that the at least one flattened engagement plate protruding from the support faces of the blocks of the first horizontal row come into abutment against the aforesaid selected internal abutment surfaces of the overlying blocks of the second row thus defining a predetermined distance between the front faces of the blocks of the second horizontal row and the front faces of the blocks of the first row and preventing the displacement thereof in only one of the two directions which are transverse to the front faces.

13. The retaining wall according to claim 11, wherein the visible face is produced in steps, the through cavity of each block being at least partially filled with earth in order to produce a replanted wall.

* * * * *